United States Patent [19]

Chen et al.

[11] 3,987,239

[45] Oct. 19, 1976

[54] HIGH VOLTAGE DC CABLES

[76] Inventors: Shee-Ming Chen, 3801 Hudson Manor Terrace, Bronx, N.Y. 10463; Spyridon Armenis, 550 Memorial Drive, Apt. 24C, Cambridge, Mass. 02139

[22] Filed: July 15, 1974

[21] Appl. No.: 488,712

[52] U.S. Cl. ..... 174/24; 174/25 R; 174/120 R; 174/121 R

[51] Int. Cl.[2] ..... H01B 7/00; H01B 9/00

[58] Field of Search ..... 174/120 R, 121 R, 120 C, 174/120 FP, 120 AR, 120 SR, 25 R, 24

[56] References Cited

UNITED STATES PATENTS

| | | | |
|---|---|---|---|
| 1,527,250 | 2/1925 | Emanueli | 174/121 R |
| 3,509,266 | 4/1970 | Endacott | 174/25 R |

FOREIGN PATENTS OR APPLICATIONS

| | | | |
|---|---|---|---|
| 928,235 | 7/1949 | Germany | 174/120 R |
| 1,568 | 1901 | United Kingdom | 174/120 R |

*Primary Examiner*—E. A. Goldberg

*Attorney, Agent, or Firm*—Rines and Rines

[57] ABSTRACT

This disclosure deals with the minimization of electric stresses and the increase of breakdown-withstanding capabilities in DC insulation systems or conductivity, or conductance and resistance, within the insulation media. The stress is kept at a minimum by arranging the layers of insulations to follow a particular pattern based on conductivity constants of the material at its distance from the conductor.

5 Claims, 12 Drawing Figures

HIGH VOLTAGE DC CABLES

The present invention relates to high voltage and extra high voltage DC (Direct Current) insulation systems, such as power transmitting cables, lead-in bushings, insulated buses, bus bars, cable joints, cable terminations and any electrical high voltage DC or similar device that have for their basic insulation, for example, liquid-solid dielectric materials, solid dielectric materials, or liquid dielectric materials. The invention is more particularly concerned with increasing the breakdown voltage of such insulation in such usages, and thus increasing the capacity and reliability of such apparatus at minimum cost.

As used herein, the term "insulation" is intended to mean any material or combinations of materials capable of being formed to cover or otherwise serve with an electrical conductor as its electrical insulation. This definition includes, therefore, the various known insulating paper tapes, oil-impregnated paper, such as cellulose paper, insulating rubber materials, the various known insulating synthetic polymeric materials, such as polyethylene, fluorocarbon polymers in film form, including fluorinated ethylene propylene copolymers, and insulating liquids such as oils, including, for example, hydrocarbon oil, selected and refined petroleum oil, polybutene or silicone oil.

Prior proposals for increasing the breakdown voltage capability of insulating media of predetermined size or thickness, apart from the finding of new and more insulative media, have almost exclusively been confined to considerations of strictly AC (alternating-current) systems, unfortunately not directly translatable or specifically applicable to the very different problems involved in DC and related operations. The design considerations involving and underlying the capacitance and dielectric constant phenomena of AC systems, of course, are totally distinct from such DC operation. U.S. Pat. No. 3,711,631, for example, is illustrative of proposals to deal with capacitance and dielectric constant with various insulating media modifications in such AC systems; with U.S. Pat. Nos. 3,194,872; 3,433,891; 3,580,987; 3,793,475; and Canadian Patent No. 545,511 being further illustrative of multiple layer and varied compositions suitable for such purposes. Different insulating materials, thicknesses and dielectric constants have been proposed, as in, for example, U.S. Pat. No. 3,749,812 and in U.S. Pat. No. 3,160,703, as a further illustration, wherein the highest dielectric insulation is centrally located within the insulative media.

These proposals and the design considerations underlying the same, as before stated, are not suited to the solution of the problem of increasing the breakdown voltage in DC and related systems; whereas it has been discovered, in accordance with the present invention, that a radically different treatment of resistivity and/or conductance must be effected, as by providing a highly novel and critical conductivity, resistivity and/or material-dimension grading distribution, to solve this very different problem.

It is an object of the present invention, accordingly, to provide novel methods of and apparatus for increasing the DC and related breakdown voltages of insulation for given dimensions, as much as 60 percent or even higher in some cases, by controlling the resistivity or conductivity, or conductance and resistance of the insulation system in a predesigned optimum manner, improving reliability of the device and also an increased capacity at minimum cost.

A further object is to provide a novel method and apparatus useful for extending breakdown insulation voltage more generally, as well.

Other and further objects will be explained hereinafter and are more particularly delineated in the appended claims.

The invention will now be described with reference to the accompanying drawing,

FIG. 1 of which is a descriptive graph of electric stress (and conductivity) as a function of radius of insulation about a cable conductor or the like, illustrating the problem underlying the invention under various loads;

Figure 5:
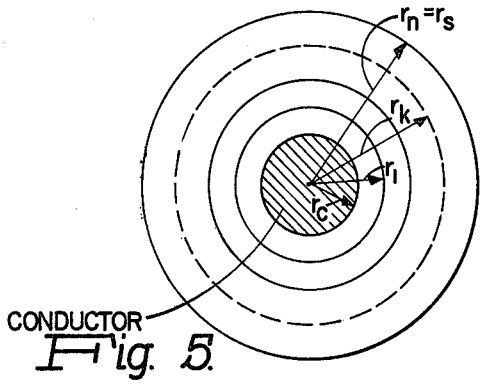
Figure 6:
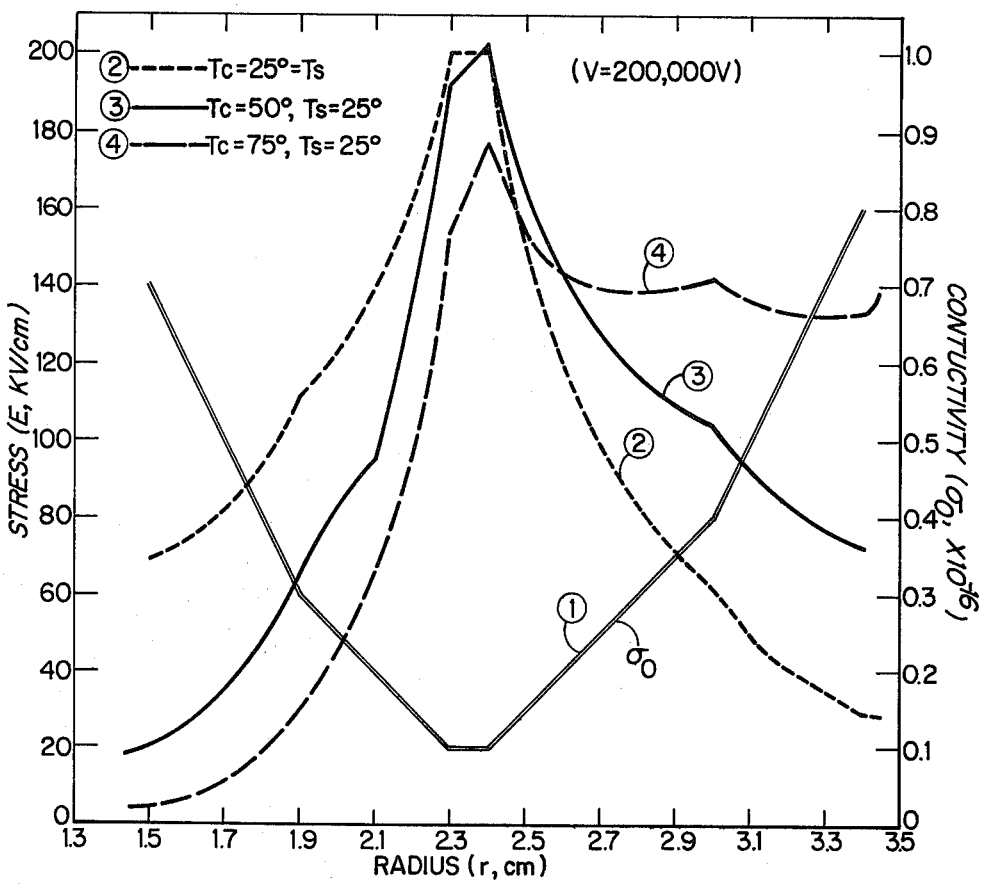
Figure 7:
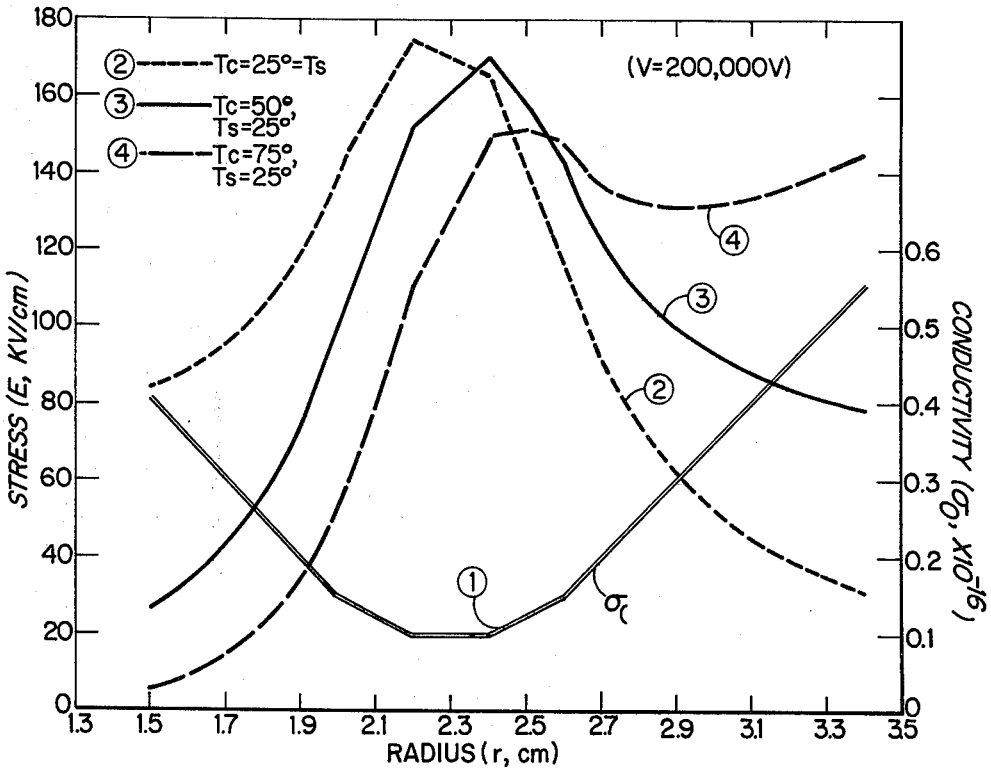
Figure 8:
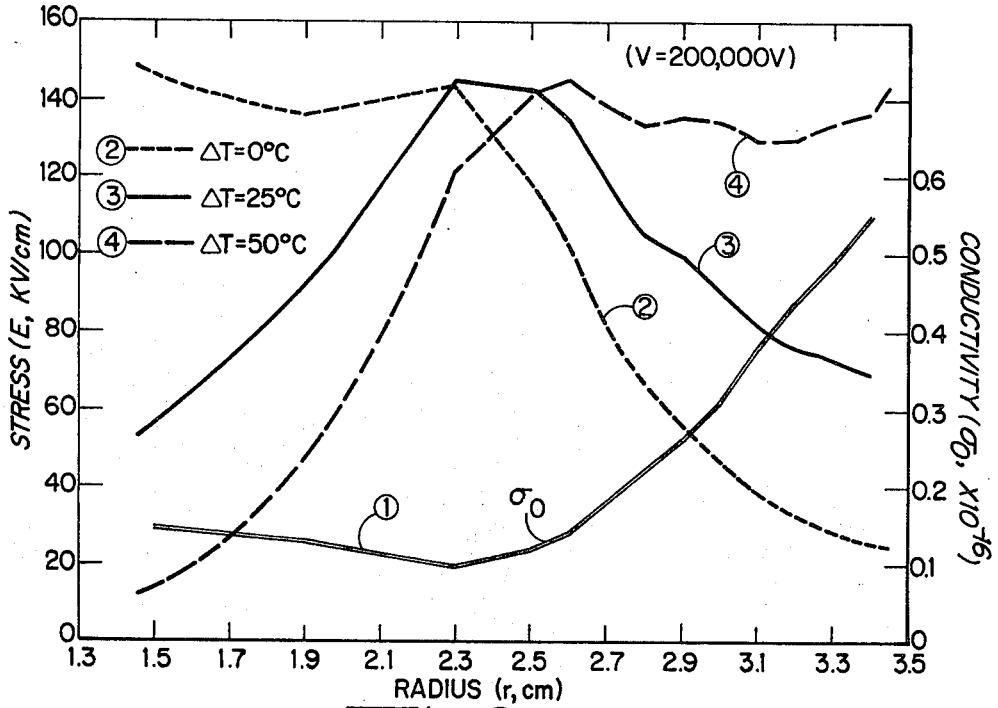
Figure 9:
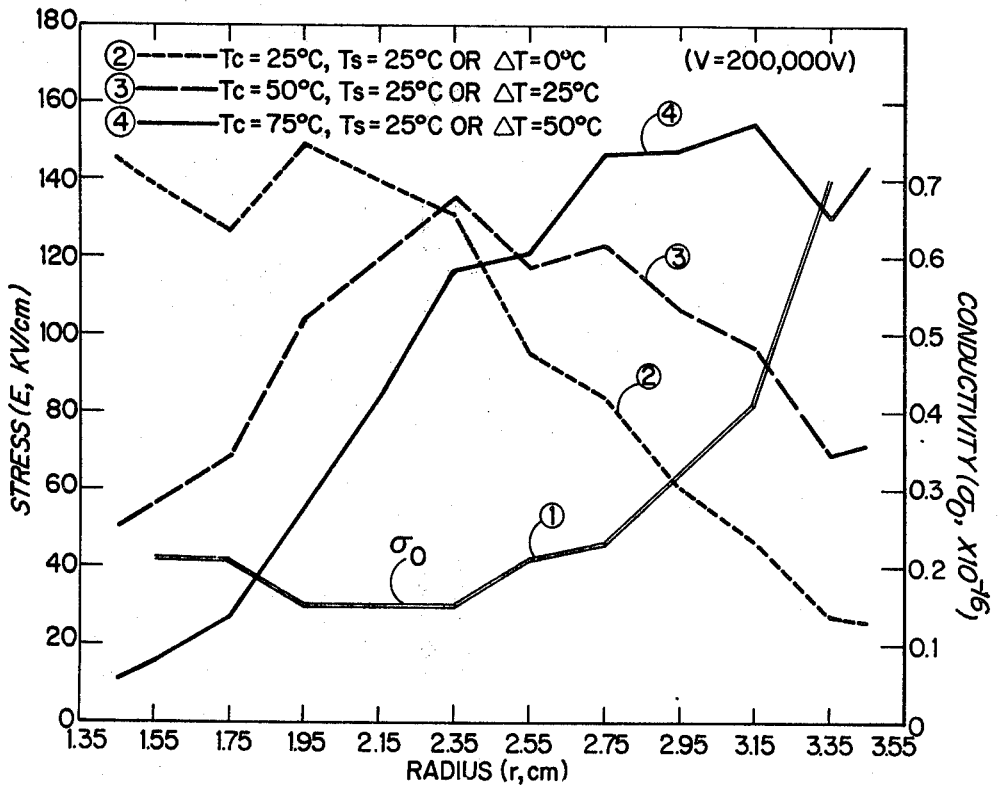

FIGS. 3A and 3B, and 4A and 4B are resistivity vs. temperature and stress graphs for exemplary oil-impregnated paper insulation and polyetheline insulators, respectively;

FIG. 5 is a sectional view of a successive-layered construction, the stress vs. radius characteristics of which with prior-art concepts are shown in FIGS. 6 and 7, and with the techniques of the invention, in FIGS. 8 and 9.

In summary, the invention relates to novel design methods of and apparatus for minimizing electric stress distributions in insulation systems, particularly in high voltage DC cables, cable joints, cable terminations, bus supports, lead-in bushings and related devices.

It is well known that in an AC cable the electric stress distribution along its radial direction inside the insulation is governed by the capacitive properties of the insulating material and is of hyperbolic form. This distribution is maintained over all practical ranges of temperature and stress, since the permittivity of the dielectric system or material is virtually constant. Thus, dielectric design of an AC cable is based on the ability of the dielectric to withstand the maximum stress.

Figure 1:
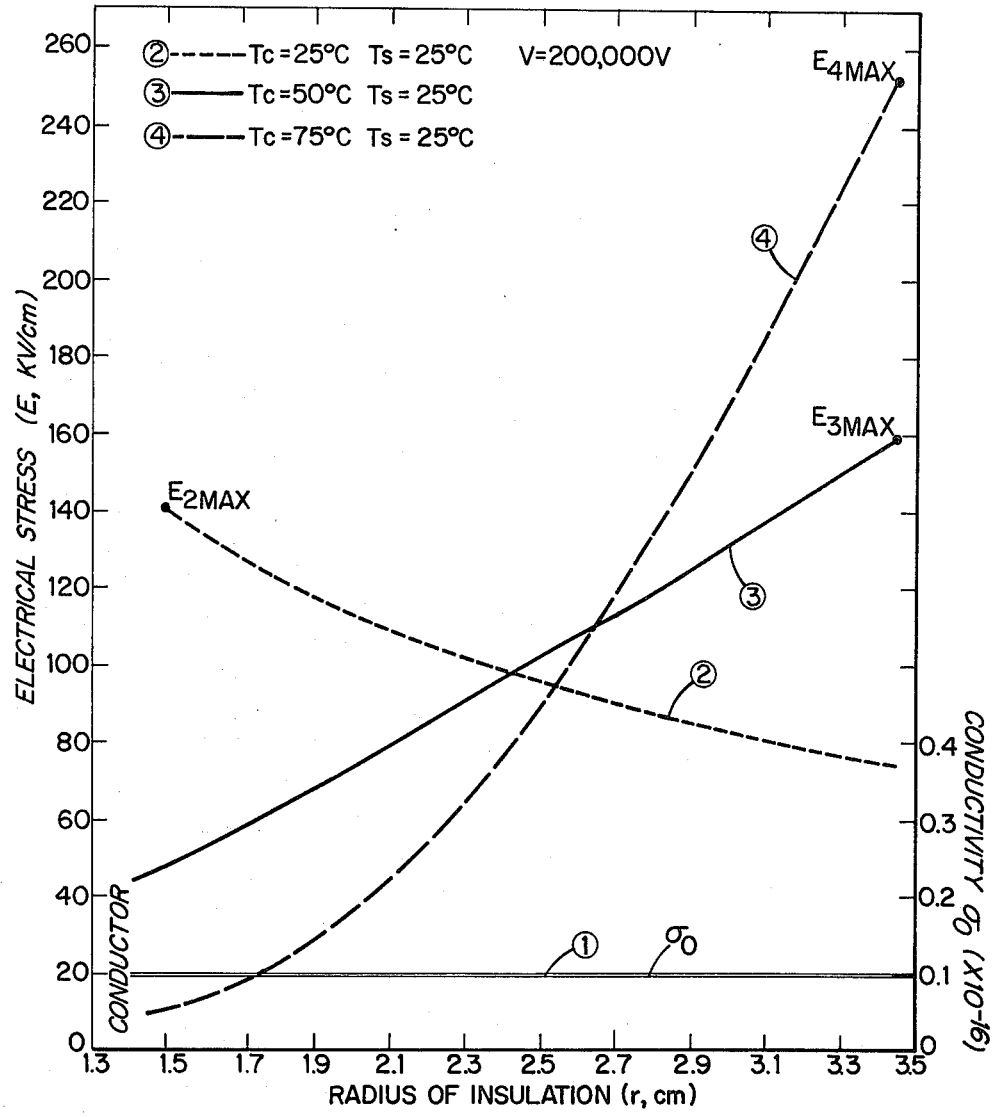

In the case of DC cables or similar apparatus, on the other hand, electric stress distribution is governed by the conductivity or resistivity of the insulation system and not by capacitive considerations. As the ionic conduction (leakage current) increases with temperature and electric stress, the stress pattern in the dielectric will change with changes in the loading of the cable. In a cold cable (no current loading), the maximum stress occurs near the conductor surface; but under load conditions, the maximum stress is shifted to the outer sheath. This phenomenon is known as "stress reversal". FIG. 1 illustrates typical stress distributions (E) with radial dimension ($r$) of insulation inside, for example, a DC cable insulation system, under various conductor temperatures, corresponding to succesively different and increasing current loading conditions $E_2$ through $E_4$; with conductivity $\sigma_o$ plotted to the right as a further ordinate. The insulation of a DC cable must be capable of withstanding the DC stresses which vary with the current loading and ambient conditions.

The power transmission capacity of a DC cable is the product of its rated voltage and current. The former is limited by the maximum stress and the latter depends upon the maximum temperature increase the dielectric can safely withstand. From FIG. 1, for example, it is clear that not only the stress distribution (E) but also its maximum value ($E_{MAX}$) changes with the dielectric temperature, which in turn depends on the current loading conditions. While it is important to be able to predict the magnitudes and locations of all these maximum stresses under different dielectric temperatures, it is, however, much more desirable if one can design the cable insulation such that the DC stress throughout the dielectric can be kept at an absolute minimum under all current loading conditions. The present invention enables one, accordingly, to design the insulation of DC cables, cable joints, terminals, supports, bus systems, lead-in bushings and related devices, with minimum electric stress by optimally flattening the stress distribution inside the cable dielectric under all current load conditions. This serves not only to increase the breakdown voltage of the dielectric, thus improving reliability, but also it enables the transmission of more power at minimum cost.

The example used herein of a DC cable of circular cross section and with oil-impregnated paper as the insulation, is presented as a convenient illustration of the principles underlying the invention; it being understood that the same principles apply to all geometries of DC devices and the like, including those in which the insulation is solid as of polyethylene, liquid as of hydrocarbon oils, or any combination of known dielectric materials in which the insulation is subjected to similar temperature and stress changes.

It is well established, experimentally and theoretically, that under DC loading, the conductivity or resistivity of present-day insulation systems varies with temperature and electric stress distributions according to the equation:

$$\sigma = \sigma_o e \alpha^{T} e \beta^{E} \quad (1)$$

where $\sigma$ is the conductivity of the dielectric or insulation at a given temperature T, in degrees C, and under electric stress E in volts per cm., $\sigma_o$ is the conductivity of the dielectric in mhos at 0° C and is a constant, and $\alpha$ and $\beta$ are the so-called temperature and stress coefficients, respectively, and are constants for all practical applications and purposes.

In FIG. 1, the stress distributions E are shown in KV per cm for different load conditions as a function of the radius of insulation $r$. This cable has oil-impregnated insulation, with $\sigma_o = 0.1 \times 10^{-16}$, $\alpha = 0.1$ and $\beta = 0.3 \times 10^{-5}$. and an applied voltage of 200 KV. Curve 1 illustrates $\sigma_o$ as of a value equal to $0.1 \times 10^{-16}$ over the insulation, and represents present-day conventional or typical high voltage cable characteristics. Curve 2 illustrates how the electric stress is distributed under no load conditions, being very similar to the AC case. Note that the maximum electric stress $E_{2\,MAX}$ is near the conductor (low value of $r$), and is equal to about 143 KV per cm. In curve 3, however, the electric stress distribution is plotted under load conditions wherein $T_c$=50° C and $T_s$=25° C, where $T_c$ is the temperature of the conductor for this particular load, and $T_s$ is the temperature at the sheath of the cable. The phenomenon of the reversal of the stress under load conditions from curve 2 should be noted. Now the maximum electric stress $E_{3MAX}$ is at the sheath (large value of $r$), and is equal to about 160 KV per cm. Curve 4 is plotted for the same cable, but under different load conditions wherein the temperature at the conductor is now Tc=75° C and Ts=25° C. The maximum electrical stress $E_{3MAX}$ is this time equal to about 254 KV per cm.

These maximum stresses and the great differences between them under different loading conditions demonstrates the problem underlying this invention, and the requirement for solving this problem by minimizing these stresses under any and all load conditions. The minimization of these maximum stresses not only will increase the reliability of the cable, but enables the operation at higher voltages under the same current loads and insulation thickness or size.

Figure 2A:
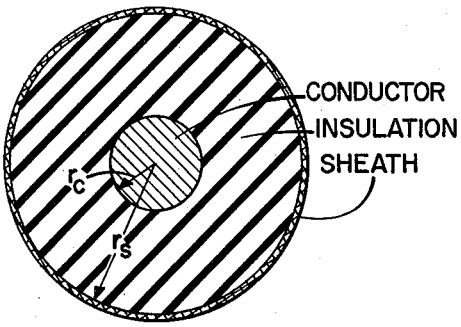
PRIOR ART Fig. 2A.
FIG. 2A is a typical cross section of a prior art insulated DC cable.
Figure 2B:
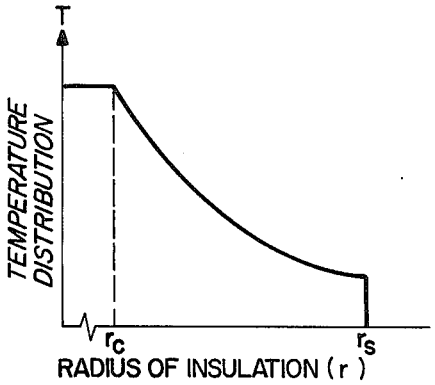
FIG. 2B is a graph of temperature distribution of the insulated cable of FIG. 2A.
Figure 3A:
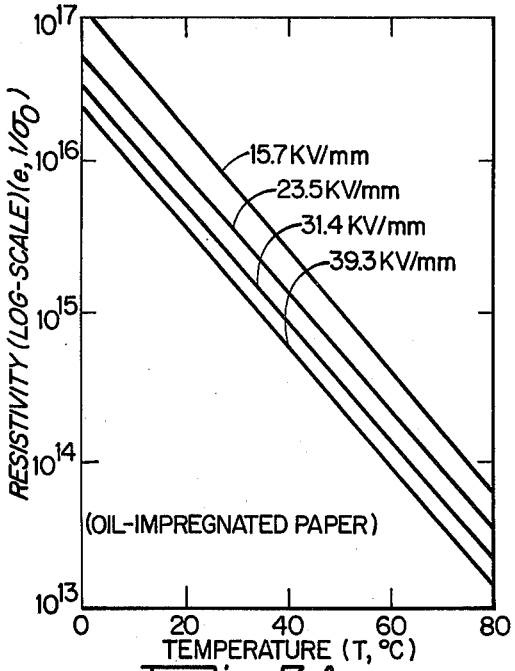
Figure 3B:
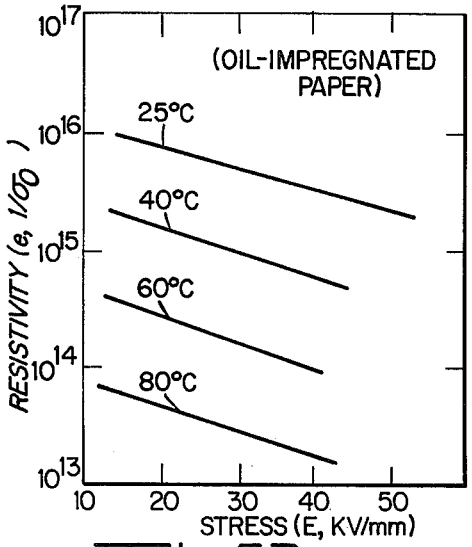
Figure 4A:
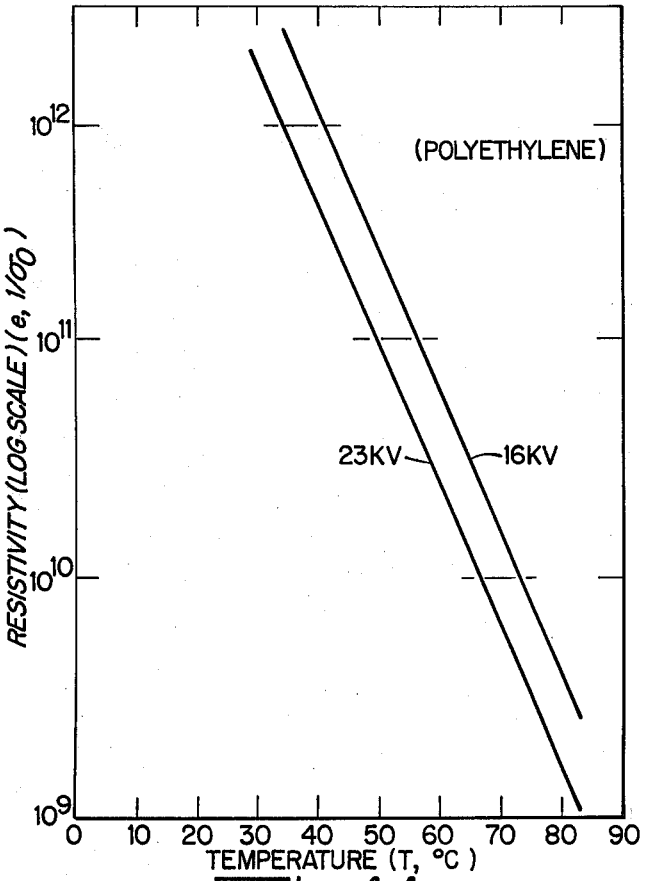
Figure 4B:
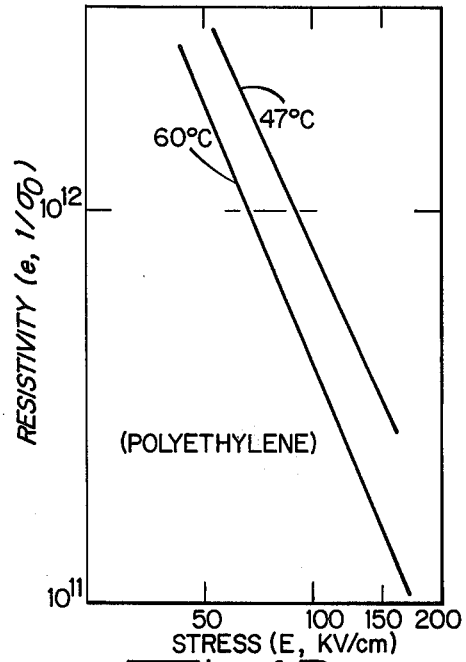

FIG. 2A is a typical cross section of a DC cable made of oil-impregnated paper, with $r_c$ and $r_s$ indicating the radii of conductor and sheath, respectively. The temperature distribution is shown in FIG. 2B and is represented by the following equation:

$$T(r) = T_c - \frac{T_c - T_s}{\ln \frac{r_s}{r_c}} \ln \frac{r}{r_c} \quad (2)$$

where $T_c$ and $T_s$ are temperatures in degrees C at the surfaces of the conductor and sheath, respectively, corresponding to given load and ambient conditions. From the above, the effect of temperature on the conductivity may be uniquely determined. If the dielectric is homogeneous, with constant conductivity, the electric stress E at a given radius $r$ from the conductor is represented by:

$$E(r) = \frac{V_C - V_S}{\ln \frac{r_s}{r_c}} \times \frac{1}{r} \quad (3),$$

where Vc and Vs are the electric potentials in volts at the conductor and sheath, respectively. Since, however, the conductivity of the dielectric is dependent upon the temperature and electric stress according to the load conditions as given by equation (1), as soon as the cable is energized, its dielectric can no longer be considered as homogeneous. Since T($r$) and E($r$) are functions of radius $r$, the conductivity $\sigma$ also varies with $r$ and equation (1) becomes as:

$$\sigma(r, T, E) = \sigma_o e \alpha^{T(r)} e \beta^{E(r)} \quad (4)$$

Equation (3), of course, is not valid under these operational conditions since the dielectric is no longer to be treated as homogeneous and it no longer has a constant conductivity $\sigma$. The actual stress distribution $E(r)$ thus depends on the conductivity distribution $\sigma(r, T, E)$ which in turn depends on the temperature distribution $T(r)$ and the stress distribution $E(r)$. such a complicated feedback case, however, readily lends itself to solution numerically using a digital computer, as later discussed.

The above-described dependence of the conductivity has been proved theoretically and experimentally, and FIGS. 3 and 4 show this dependence from experimental results. FIG. 3 is a log-linear curve of the resistivity of oil-impregnated paper, showing this dependence quite clearly for temperature in ° C and electric stress in KV/cm. FIG. 4 shows the same log-linear variation phenomenon of the resistivity versus temperature in ° C and electrical stress in KV/cm, but this time, for a solid insulation medium of polyethylene; thus demonstrating the applicability of the invention to solid, liquid and liquid-solid insulation systems.

The actual stress distribution $E(r)$ can be obtained by visualizing the insulation of a DC cable composed of $n$ concentric layers of the same dielectric material (same $\sigma_o$) but different in the actual resulting conductivity $\sigma(r)$. FIG. 5 illustrates the cross-section of such a cable, composed of $n$ equal successive continuous sections or layers of the same dielectric material. The voltage potential in the Kth layer can be represented by the equation:

$$E(r_k) = \frac{dv}{dr}\Big]_{r=r_k} = \frac{Vc - Vs}{\sum_{j=k}^{N} \frac{1}{\sigma_k} \ln \frac{rk}{r_{k-1}}} \frac{1}{\sigma_k} \frac{1}{r_k} \quad (5).$$

The values of $\sigma(r)$ and $E(r)$ can now be obtained with a high degree of accuracy.

Through use of these relationships the invention enables one to design an insulation system which will minimize the maximum electric stresses under any load conditions and optimally flattening the stress distribution, thus to obtain the absolute minimum of the maximum electric field under any load conditions and for any of solid, liquid, solid-liquid insulation system.

The applied voltage Vc-Vs is given by the expression:

$$Vc - Vs = \int_{r_s}^{r_c} E(r)\, dr \quad (6)$$

wherein, as shown in FIG. 1, it is required that the areas between $r_c$ and $r_s$, bounded by each stress distribution curve under any load conditions, be the same.

Underlying the present invention, accordingly, is the concept of keeping the stress inside the dielectric to the absolute minimum by bending or flattening these stress distribution curves horizontally, while still enclosing the same area corresponding to the applied voltage $V_c$-$V_s$ as dictated by equation (6).

In accordance with the invention, it has been discovered that the way to achieve the above goal is appropriately to control the resistivity or conductivity distribution of the insulation system. From equation (4) it can be seen that the parameters which can be controlled or manipulated are $\sigma_o$ and $r$ since $\alpha$ and $\beta$ are rather constant for all known dielectrics and cannot be substantially controlled for all practical purposes. There is, however, a wide range of $\sigma_o$ values for present-known dielectrics and combinations of different dielectric materials. It has been found experimentally that there exist important practically attainable variations which are, for example, at least in the ratio of 1 to 10.

The second parameter that can be controlled is $r$ (or A), the thickness (or area) of different layers. While for some manufacturing and testing procedures and convenience, the thickness of the layers will be kept the same, for special applications or requirements, it can be desirable also to control the thickness of the different layers. Two illustrative cases may be considered. The first case is where the $\sigma_o$ (resistivity or conductivity) alone is controlled; i.e. a conductivity or resistivity controlled insulation system. The second case is where $\sigma_o$ or $r$ and A (the thickness or area of different layers) are controlled, this being defined as a conductance or resistance controlled insulation system.

As an example, the DC cable insulation can be made up by a number of concentric dielectrics (extruded or in tape form, for example) of different conductivity $\sigma_o$ constants. By properly arranging the layers of different $\sigma_o$, flattened stress distribution curves may be obtained. FIGS. 6 and 7 are typical sets of stress distributions resulting from certain arrangements of $\sigma_o$. The cable of this example is the same as in FIG. 1, but with different $\sigma_o$ distribution in the insulation. Curve 1 in each of FIGS. 6 and 7 is the chosen insulation system distribution, using the concept of equal thickness insulation layers or sections and a resistivity controlled insulation system. Curves 2, 3 and 4 represent stress distributions corresponding to no-load, medium load and full load conditions for a chosen $\sigma_o$ distribution.

The present invention affords techniques for optimizing these results. Optimum arrangements of $\sigma_o$ distribution have indeed been found to be obtainable. The solution of simultaneous equations of the form (5), under three different conductor temperatures, corresponding to no-load, medium load and full load conditions has yielded optimum results in this connection. Having achieved the minimum value that the different maximum stresses can achieve, then using equation (4), the optimum distribution for $\sigma_o$ can be determined.

FIG. 8 shows such an optimum distribution curve 1, for $\sigma_o$, in which, in accordance with the invention, for a cable with 20 equal-thickness insulation layers or sections, the $\sigma_o$ distribution as a function of radius assumes a substantially flat and then unsymmetrically steeply rising distribution. Comparing the same with FIG. 1, it will be observed that a surprising reduction of 60 percent of the maximum electrical field $E_{max}$ is obtained with a load of 200 KV, and with a fairly uniform or flat response 4 throughout the insulation for full load, and 60 percent less stress, also, for medium-load and no-load conditions (curves 2 and 3).

Even better results can be obtained using resistance controlled insulated systems wherein the radius or thickness of the different layers or sections of different $\sigma_o$ values is also controlled. This decision of course depends on the specific requirements, application, cost and convenience of manufacturing processes. Actually, the relative rather than absolute values of $\sigma_o$ are of importance, making the selection of the different dielectrics more convenient and easier to achieve. This same principle, of course, may be used, as before stated, with dielectrics in the form not only of tapes or laminations or layers, but with solid dielectrics, such as the previously mentioned polymers and the like, and also liquids, as by proper control with concentric partitions, made to separate each layer or section. The invention applies equally well to non-circular cross-section and/or multi-dimensional DC devices, such as cable joints, cable terminations. lead-in bushings, insulated busbars, buses and related devices as earlier mentioned. The electric stress distribution inside the dielectrics may be kept to the absolute minimum under all practical load conditions. For the same power handling capacity the size of the device can be reduced or its reliability increased; or for the same material used, the power carrying rating can be increased, accordingly.

FIG. 9 illustrates the performance of a practical example of realistic design in which the insulation system was composed of only six different dielectric material layers or sections of the following successively different conductivities $\sigma_o$: (1) Mass-impregnated with oil resin of conductivity constant $0.21 \times 10^{-16}$; (2) paper dielectric pre-impregnated with petroleum jelly and of conductivity constant $0.15 \times 10^{-16}$; (3) oil/microcrystalline wax membrane with conductivity constant 0.23 ×

$10^{-16}$; (4) mass-impregnated oil-filled with conductivity constant $0.32 \times 10^{-16}$; (5) oil resin with polyisobutylene and conductivity constant $0.41 \times 10^{-16}$; and (6) paper dielectric oil-impregnated with conductivity constant $0.7 \times 10^{-16}$. Curve 1 in FIG. 9 shows the optimum distribution of the conductivity constants with the first part relatively flat and then sharply increasing at greater radii. Curves 2, 3 and 4 illustrate the electric stress distribution under no-load, medium load and full load conditions, respectively. Comparing this practical design which is composed of only six $\sigma_o$ layers or sections, with the example of FIG. 8, in which 20 $\sigma_o$ layers or sections were used, it will be observed that comparable improved results have been obtained with substantially the same maximum electric stress and with a 60 percent reduction of the maximum stress for the same cable and load conditions as compared with the example of FIG. 1.

It will be obvious to those skilled in the art, that this invention permits of various further modifications and can be embodied in cables and other systems other than as particularly illustrated and described herein, without departing from the essential features of the invention and within the spirit and scope of the claims annexed hereto.

What is claimed is:

1. Insulated conductor apparatus having, in combination, successive sections of insulation disposed at successive contiguous distances $r$ from a conductor to which DC voltage is to be applied that electrically stresses the medium, the successive sections being of successively different conductivities $\sigma_o$ following an unsymmetrical conductivity distribution through the insulation and generally having a relatively low, substantially flat region for distances closer to the conductor and increasing steeply to relatively higher values at distances more remote from the conductor in order to minimize electric stress in the medium at all load conditions and flatten the electric stress distribution over said sections, under load.

2. Insulated conductor apparatus as claimed in claim 1 and in which said voltage is of the order of tenths and hundreds of DC kilovolts and the said conductivity ratio distribution extends within a range of at least 1 to 10.

3. Insulated conductor apparatus as claimed in claim 2 and in which said sections are substantially equal-thickness layers.

4. Insulated conductor apparatus as claimed in claim 2 and in which said sections are of different thicknesses.

5. Insulated conductor apparatus as claimed in claim 2 and in which said insulation is selected from the group of dielectric materials consisting of solid, liquid and liquid-solid insulators.

* * * * *